US009642504B2

(12) United States Patent
Andersson

(10) Patent No.: US 9,642,504 B2
(45) Date of Patent: May 9, 2017

(54) END PLUG FOR CORELESS PAPER ROLLS

(75) Inventor: Anders Andersson, Stenungsund (SE)

(73) Assignee: SCA HYGIENE PRODUCTS AB, Gothenburg (SE)

( * ) Notice: Subject to any disclaimer, the term of this patent is extended or adjusted under 35 U.S.C. 154(b) by 949 days.

(21) Appl. No.: 13/002,052

(22) PCT Filed: Jul. 23, 2008

(86) PCT No.: PCT/SE2008/050887

§ 371 (c)(1),
(2), (4) Date: Dec. 30, 2010

(87) PCT Pub. No.: WO2010/011165

PCT Pub. Date: Jan. 28, 2010

(65) Prior Publication Data

US 2011/0114778 A1 May 19, 2011

(51) Int. Cl.

| | |
|---|---|
| ***A47K 10/40*** | (2006.01) |
| ***B65H 75/18*** | (2006.01) |
| *B65H 75/24* | (2006.01) |
| *A47K 10/32* | (2006.01) |

(52) U.S. Cl.

CPC ..... *A47K 10/40* (2013.01); *B65H 75/185* (2013.01); *A47K 2010/3206* (2013.01); *B65H 75/245* (2013.01); *B65H 75/246* (2013.01)

(58) Field of Classification Search

CPC .. B65H 75/185; B65H 75/187; B65H 75/242; B65H 75/245; B65H 75/246; B65H 16/06; B65H 19/126; B65H 2301/4134; B65H 2301/41346; A47K 10/40; A47K 2010/3206

USPC ... 242/571, 571.6, 596, 596.7, 597.5, 597.6, 242/599, 599.4, 607, 607.1, 611, 613, 242/613.1, 118.2, 577, 577.3

See application file for complete search history.

(56) References Cited

U.S. PATENT DOCUMENTS

| | | | | |
|---|---|---|---|---|
| 676,335 | A * | 6/1901 | Moffatt | 242/571.6 |
| 1,008,924 | A * | 11/1911 | Orr | 242/613.5 |
| 1,935,367 | A * | 11/1933 | Bebie et al. | 242/613.5 |
| 2,219,124 | A | 10/1940 | Bandy | |
| 2,419,798 | A * | 4/1947 | Stone | 242/571.5 |
| 2,537,184 | A | 1/1951 | Dunn | |
| 2,956,757 | A * | 10/1960 | Limbach | 242/571.6 |

(Continued)

FOREIGN PATENT DOCUMENTS

| | | |
|---|---|---|
| CN | 1185405 A | 6/1998 |
| DE | 4123868 A1 | 1/1992 |

(Continued)

OTHER PUBLICATIONS

Machine translation of FR 2688861 A1.*

(Continued)

*Primary Examiner* — Sang Kim
*Assistant Examiner* — Nathaniel Adams
(74) *Attorney, Agent, or Firm* — Buchanan Ingersoll & Rooney PC

(57) ABSTRACT

An end plug for coreless paper rolls includes a central body. At least three resilient elements protrude from the central body and press resiliently against the interior of a paper roll when the end plug is inserted into an end of the paper roll, the radial extension of the resilient elements being influenced by rotation of the plug or a part thereof.

13 Claims, 7 Drawing Sheets

(56) References Cited

U.S. PATENT DOCUMENTS

| | | | | | |
|---|---|---|---|---|---|
| 2,964,174 | A | * | 12/1960 | Litchfield et al. | 242/160.1 |
| 3,115,969 | A | | 12/1963 | Beaudoin | |
| 3,285,528 | A | * | 11/1966 | Beindorf | 242/571.5 |
| 3,840,194 | A | | 10/1974 | Vetter | |
| 3,865,326 | A | * | 2/1975 | Beaudoin | 242/613.5 |
| 4,752,045 | A | | 6/1988 | Goldstein | |
| 4,783,016 | A | * | 11/1988 | Pool | B05B 15/0456 242/571.4 |
| 5,267,704 | A | | 12/1993 | Kitamura et al. | |
| 5,370,339 | A | * | 12/1994 | Moody et al. | 242/597.6 |
| 5,683,058 | A | * | 11/1997 | Schwarz et al. | 242/578.2 |
| 5,820,069 | A | | 10/1998 | Segura Salvador et al. | |
| 6,561,453 | B1 | | 5/2003 | Shinga | |
| 7,431,236 | B2 | | 10/2008 | Larsson | |
| 7,438,256 | B2 | * | 10/2008 | Nip | A47K 10/3836 242/597.7 |

FOREIGN PATENT DOCUMENTS

| | | | | |
|---|---|---|---|---|
| DE | 10017787 | A1 | | 7/2001 |
| FR | 2688861 | A1 | | 9/1993 |
| FR | 2904816 | A1 | * | 2/2008 |
| GB | 2034860 | A | | 6/1980 |
| GB | 2362375 | A | | 11/2001 |
| RU | 2339565 | C2 | | 11/2008 |
| WO | 9308112 | A1 | | 4/1993 |
| WO | 2007065686 | A2 | | 6/2007 |
| WO | 2007/111544 | A1 | | 10/2007 |
| WO | 2007/111561 | A1 | | 10/2007 |

OTHER PUBLICATIONS

English translation of FR 2904816 A1.*

International Search Report, dated Apr. 1, 2009, from corresponding PCT application.

English translation of Russian Decision on Grant dated Jul. 12, 2012, from corresponding RU application.

Office Action (Notification of the First Office Action) dated Apr. 19, 2013, issued in corresponding Chinese Patent Application No. 200880130467.0, and an English Translation of the Office Action. (11 pages).

European Supplementary Search Report dated Dec. 5, 2013 issued in the corresponding European Patent Application No. 08876632.4 (6 pages).

European Search Report dated Feb. 9, 2015 issued in the corresponding European Patent Application No. 14193727.6-1705 (7 pages).

* cited by examiner

END PLUG FOR CORELESS PAPER ROLLS

TECHNICAL AREA

The present invention relates to an end plug for coreless paper rolls including a central body and to a paper roll provided with at least one such end plug.

BACKGROUND OF THE INVENTION

Historically paper rolls, such as toilet rolls, are provided with a core of a relatively stiff material, usually cardboard. It is, however, not unusual that the circular cross-section of such a roll is deformed during storage, transport and use of such a paper roll, so that the cross-section becomes oval. An oval cross-section of the core prevents a smooth unwinding of paper from the roll.

Nowadays also coreless paper rolls are known. Coreless paper rolls are wound without a carton core directly upon a shaft to a "log". When the log is finished, the shaft is drawn out to leave a hole in the centre of the log. The log is then cut sideways into correct width for customer rolls. The windings nearest the hole in the roll has a tendency to partly collapse, making the hole starshaped or in other ways uneven. An advantage by such rolls is that for the same outer diameters, a coreless paper roll contains more paper than a roll provided with a core. Another advantage compared to rolls with cores is that no waste material which has to be discarded exists after use of a coreless paper roll. A problem with coreless paper rolls is that the cross-section thereof can be deformed which results in difficulties in applying the roll in a dispenser and also an uneven unwinding of paper from a roll applied to a dispenser. This problem has been solved by providing end plugs to be inserted into one or opposite ends of a coreless paper roll depending on the type of dispenser being used.

Coreless paper rolls provided with correctly inserted end plugs are easy to apply to a dispenser and ensure a smooth unwinding of the paper on the roll.

It is desirable that such end plugs are tightly applied to the interior of the paper roll so that the roll can not slip in relation to the plug but will rotate together with the plug. Moreover, if the end plugs are inserted into the paper rolls in connection to manufacture thereof, i.e. before storing thereof and transport to the end consumer, it is important that the end plugs stay in place after insertion. In order to facilitate insertion of the end plugs these are often slightly conical or have a tapering insertion end. However, due to the deformation of a coreless paper roll it is sometimes difficult to fully insert end plugs which can result in difficulties in applying the paper roll to a dispenser. Furthermore, to ensure the desired function of a conventional cylindrical end plug, a tight fit between the interior surface of the roll and the outer surface of the plug is necessary. However, due to manufacturing tolerances for the rolls it can occur that an end plug having a perfect fit to one roll has a loose fit to another roll. There is thus a need for improvements of end plugs for coreless paper rolls.

The objective of the present invention is to fill this need and provide an end plug for coreless paper rolls which is easy to apply and which will fit tightly.

SUMMARY OF THE INVENTION

This objective is accomplished by an end plug for coreless paper rolls including a central body, characterised by at least three resilient elements protruding from the central body and resiliently pressing against the interior of the paper roll when the end plug is inserted into an end of a paper roll, the radial extension of the resilient elements being influenced by rotation of said plug or a part thereof. Such resilient elements can be brought to or held in an inward position during insertion of the end plug and allowed to expand to an outward position after the insertion thereof.

In a first preferred embodiment, the central body has an axial extension and said resilient elements are extended axially along the central body and protrude outwardly therefrom, said resilient elements being wing-shaped, and wherein an imaginary line between the tip of the wing-shaped element and the base thereof, i.e. the interface between the central body and the wing-shaped element, forming an acute angle to a tangential plane passing through said base. Preferably, said wing-shaped elements are arcuate. Such an end plug allows rotation in one direction, the wing-shaped elements then being bent inwards towards the central body if in contact with the interior wall of a paper roll whereas rotation in an opposite direction is obstructed when the wing-shaped elements are in contact with an interior wall of a paper roll. After insertion by pushing and rotating the end plug, the bent-in wing-shaped elements have a tendency to bend back to their initial position and will thereby resiliently press against the interior wall of the paper roll.

In a variant of the first preferred embodiment, each wing-shaped element is divided by a hinge line into a tip portion and a base portion. When such an end plug is fully inserted, the end plug is counter-rotated whereby the tip portion will swing around its hinge line and resiliently press against the interior wall of the paper roll, locking the end plug in position.

In a second preferred embodiment, the central body has an axial extension and said resilient elements are extended axially along the central body and protrude outwardly therefrom, said resilient elements being wing-shaped, and wherein the angle between an axial plane, which passes through the base of the wing-shaped element, i.e. the interface between the central body and the wing-shaped element, and the wing shaped element is variable by rotating a second body in relation to the central body, said second body having axially extending parts abutting the wing-shaped elements at a distance from the base thereof during rotation of the second body in relation to the central body.

In a third preferred embodiment the resilient elements are protruding axially from the central body and are attached thereto to be swingable in a radial plane, the central body comprises means for swinging the resilient elements from a rest position inside of the circumference of the central body to a work position outside of the circumference of the central body.

In a fourth preferred embodiment the resilient elements are tongues protruding in the circumferential direction from the central body, the central body including means for swinging said tongues outwardly from the circumference of the central body.

In a fifth preferred embodiment the resilient elements are extending in an axial direction from the central body and are, in a rest position, held inside a cylindrical wall of a second body coaxially enclosing the central body, said cylindrical wall having a row of openings therein, and wherein the second body is rotatable relative to the central body for bringing the resilient elements to a work position in which portions of the resilient elements snap into said openings and extend outside the cylindrical wall.

The invention also relates to a coreless paper roll having an end plug according to any of claims 1-8 inserted into at least one end thereof.

BRIEF DESCRIPTION OF THE DRAWINGS

The invention will now be described with reference to the enclosed figures, of which.

DESCRIPTION OF EMBODIMENTS

Figure 2:
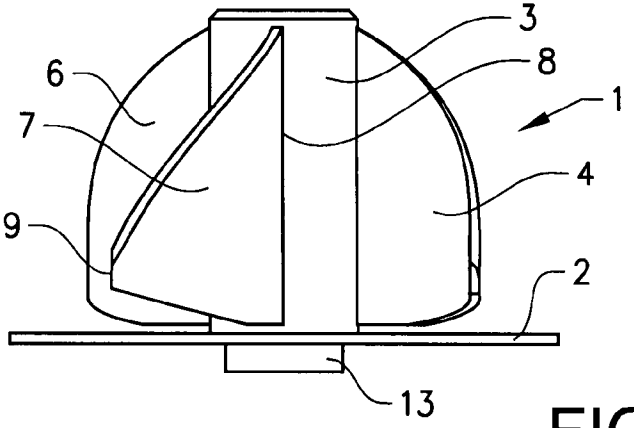
Figure 3:
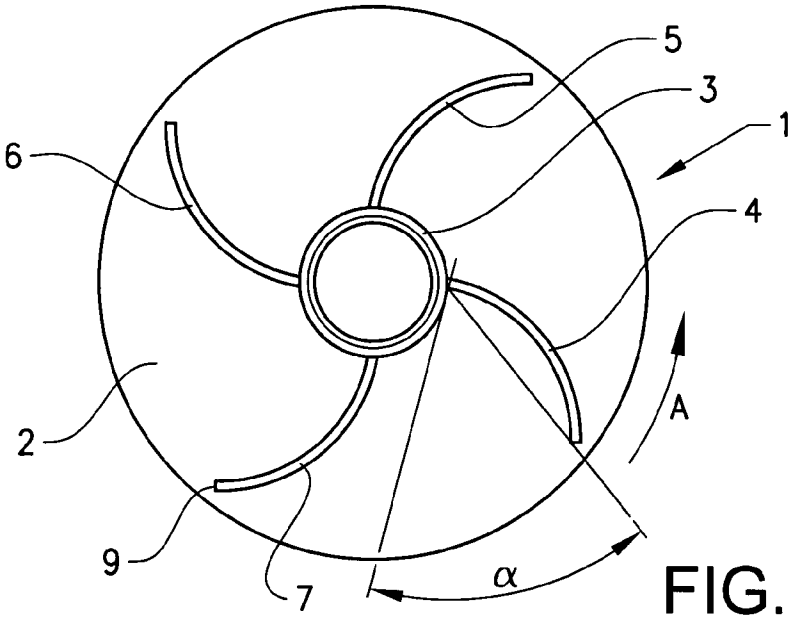
Figure 1:
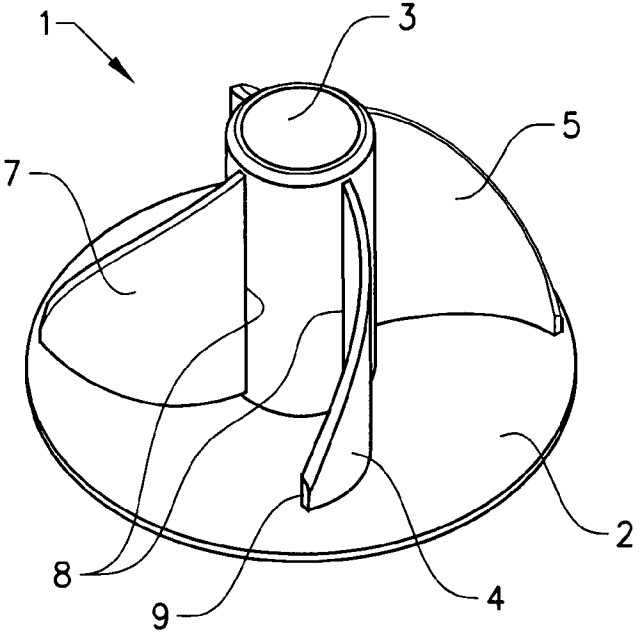
FIG. 1 discloses a perspective view of an end plug according to a first preferred embodiment, FIG. 2 discloses a side view of the end plug in FIG. 1, FIG. 3 discloses an end view of the end plug in FIG. 1 seen with its insertion end turned towards the viewer, FIG. 4 discloses a perspective view of an end plug according to a variant of the first preferred embodiment, FIGS. 5,6 and 7,8, respectively disclose a side view and end view of the end plug in FIG. 4 in different insertion positions, FIG. 9 discloses an exploded perspective view of an end plug according to a second preferred embodiment, FIGS. 10 and 11 disclose a side view and an end view, respectively of the end plug in FIG. 9 in an assembled condition, FIG. 12 discloses an exploded perspective view of an end plug according to a variant of the second embodiment, FIGS. 13,14 and 15,16, respectively disclose a side view and an end view, respectively of end plug according to FIG. 12 in assembled condition and in two different insertion positions, FIG. 17 discloses an exploded perspective view of an end plug according to a third preferred embodiment, FIGS. 18 and 19, respectively disclose an end view, respectively of the end plug in FIG. 17 in assembled condition and in two different insertion positions, FIG. 20 discloses an exploded perspective view of an end plug according to a fourth preferred embodiment, FIGS. 21,22 and 23,24, respectively disclose a plan view and an end view of the end plug according to FIG. 22 in assembled condition and in two different insertion positions, FIG. 25 discloses an exploded view of an end plug according to a fifth preferred embodiment, and FIGS. 26 and 27, respectively disclose a perspective view of the end plug according to FIG. 25 in assembled condition and in two different insertion positions.

A first embodiment of an end plug 1 according to the present invention is shown in FIGS. 1-3. The plug 1 includes an end plate 2 intended to lie against a side of a coreless paper roll when the plug has been inserted into the centre hole therein. The plug also has a central body 3 protruding from the centre of plate 2 perpendicular to the plate. Four wing-shaped elements 4-7 are protruding outwardly from the central body 3.

Each wing-shaped element 4-7 has a base 8 being the interface between the central body 3 and the respective element 4-7, and a tip 9. Furthermore, each element 4-7 is inclined relative a radial direction so that an imaginary line between the tip of the wing-shaped element and the base thereof forms an acute angle $\alpha$ to a tangential plane passing through said base. The wing-shaped elements are moreover tapering from their ends adjacent the end plate 2 towards the opposite ends thereof lying adjacent to the end of the plug 1 opposite to the end plate 2, hereafter called the insertion end of the plug.

In the end opposite to the insertion end of the plug, the central body has a peg 13 or the like protruding from the end of the central body 3 for attachment of a roll to a dispenser after insertion of the end plug 1 into its central hole. The peg 13 can also be constructed in such a way as to facilitate rotation of the end plug by hand or by help of a tool.

The wing-shaped elements are for example made of polyethylene, so that they can be resiliently bent towards and away from the position shown in FIGS. 1-3. Many other resiliently bendable material materials are suitable in end plugs according to the invention.

The end plug 1 functions in the following way.

To insert an end plug 1 into the hollow interior of a coreless paper roll, the insertion end is pushed into the interior of the roll until two or more of the wing-shaped elements 4-7 come to abutment against the interior wall of the paper roll. Thereafter the plug 1 is simultaneously pushed and rotated in the direction of the arrow A in FIG. 3, i.e. in a clockwise direction. Since the wing-shaped elements 4-7 are tapering towards the insertion end they are easy to place in abutment against the interior wall of the roll in the beginning of the insertion procedure. The reaction forces from the interior wall of the roll acting on the outermost surfaces of the wing-shaped elements will produce an inward bending of the elements 4-7, i.e. the angle $\alpha$ will be reduced, and the position of the tips 9 of the elements 4-7 will be moved in towards the central body. Simultaneously, the resilient forces of the elements 4-7 act on the interior wall of the roll. The insertion of the end plug 2 will thus be easy to perform by simultaneous pushing and clockwise rotating of the end plug 1. Incidentally, if the plug is rotated anticlockwise instead of clockwise when the wing-shaped elements are in contact with the interior wall of a coreless paper roll, the tips of wing-shaped elements will try to move outwards away from the central body, thereby trying to increase the angle $\alpha$, the rotational movement thus being obstructed by said interior wall.

In the variant of the first embodiment shown in FIGS. 1-3, the wing-shaped elements 4-7 are arcuate so that they have arcuate cross-sections in a horizontal plane. This is preferred since it facilitates a smooth bending and abutting of the wing-shaped elements during clockwise rotation of the end plug 1 in the interior of a coreless paper roll. By such an arcuate shape, the wing-shaped elements can be bent towards the central body 3 both by a decrease of angle $\alpha$ and by an increase of their curvatures. It is, however, also possible to use wing-shaped elements which are straight, i.e. having straight cross-sections in a horizontal plane.

When the end plug 1 is inserted into the end of a paper roll so that its end plate 2 is in abutment to the side of the paper roll, the rotation and pushing of the end plug is stopped. The wing-shaped elements 4-7 then strive to retain their start positions and will therefore resiliently press against the interior wall of the paper roll provided the radial extension of the wing-shaped elements is greater than the radius of the central hole in the coreless paper roll.

Figure 5:
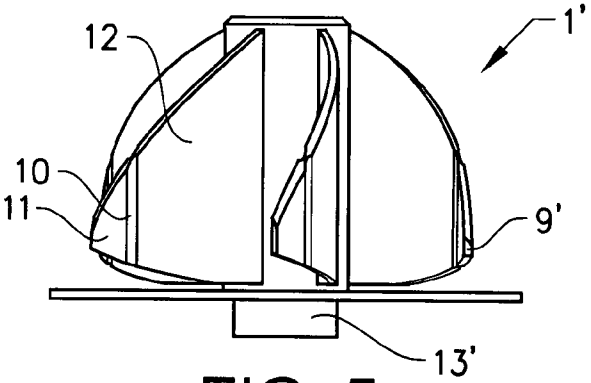
Figure 6:
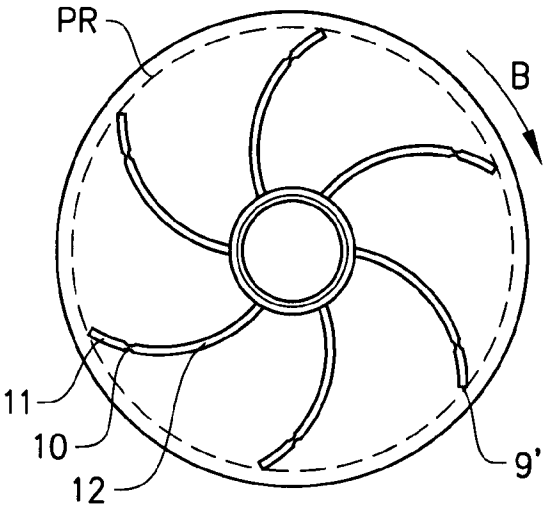
Figure 4:
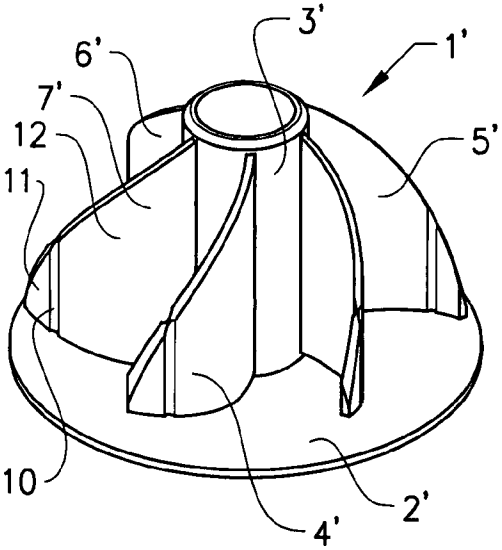

It is to be noted that during the rotation of the end plug 1, the forces of the wing-shaped elements will influence the interior wall of the coreless paper roll to have a circular cross-section. Possible deviations from a circular shape of the central hole in the coreless paper roll will thus be removed by the insertion of the end plug, at least in the end portion thereof. As a matter of fact, the central hole of a coreless paper roll usually differs from having a perfect circular cross-section. When the end plug is inserted into a deformed central hole of the paper roll, all wing-shaped elements will not at the same time come into abutment with the interior wall of the paper roll. However, during rotation of the plug all wing-shaped elements will pass the narrowest part of said wall and try to expand this part by their resilient force. The simultaneous pushing and rotation of the end plug will thus accomplish both a circular shape of the cross-section of the interior wall of the paper roll, at least in and end part thereof, as well as a centering of the end plug inserted into the central hole of the paper roll In FIGS. 4-8 an end plug 1' according to another variant of the first embodiment shown in FIGS. 1-3 is shown. This end plug 1 differs from the end plug described with reference to FIGS. 1-3 only in that a hinge line 10 divides each wing-shaped element 4'-7' into a tip portion 11 and a base portion 12. In all other aspects the end plug 1' according to FIGS. 4-6 is identical with the end plug described with reference to FIGS. 1-3. Components in the variant according to FIGS. 4-8 being similar to components in the variant according to FIGS. 1-3 are therefore given the same reference numerals with an addition of a prime sign.

The hinge line 10 has an axial extension and is preferably accomplished by a weakening line. However, other ways of creating a hinge line can of course be used, such as cutting the wing-shaped element into two pieces and thereafter joining these pieces together by a join allowing said pieces to rotate in relation to each other. Such a join can be a piece of flexible material attached to portions of the tip portion and the base portions on each side of said hinge line.

Figure 7:
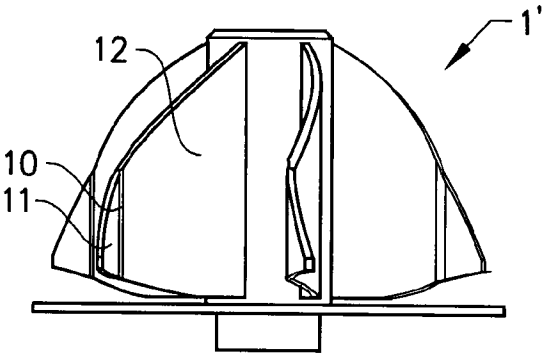
Figure 8:
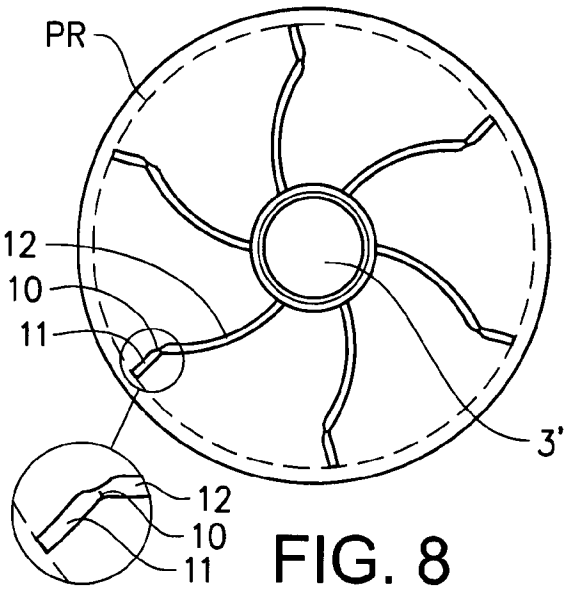

The end plug 1' according to the variant shown in FIGS. 4-8 is inserted into an end of a paper roll in the same way as has been described with reference to FIGS. 1-3. The fully inserted end plug is schematically shown in FIGS. 5 and 6 whereby the interior wall of the paper roll is schematically indicated in FIG. 6 by an interrupted line PR. As can be seen in FIG. 6, the tips 9' of resilient elements 4'-7' press against the interior wall PR. Thereafter the end plug is rotated a short distance anticlockwise as is indicated by arrow B in FIG. 6. The tip portions 11 will then swing about their points in abutment with the interior wall PR which will cause an inward bending of the base portions 12 of the wing-shaped elements 4'-7'. This configuration of the end plug is shown in FIGS. 7 and 8. This bending of the wing-shaped elements will increase the resilient force of these elements acting on the interior wall. Preferably the surfaces of the weakening line 10 is such that they meet each other when the tip portions 11 take a radial position in relation to the central body 3 as is schematically illustrated in the view in larger scale of a detail of FIG. 8. Such a configuration of the weakening line 10 will prevent further anticlockwise rotation of the end plug 1' and lock the end plug in place.

In a variant the end plates 2,2' of end plugs 1,1' can be provided with notches or indentation (not shown) for facilitating rotation of the plugs.

Figure 10:
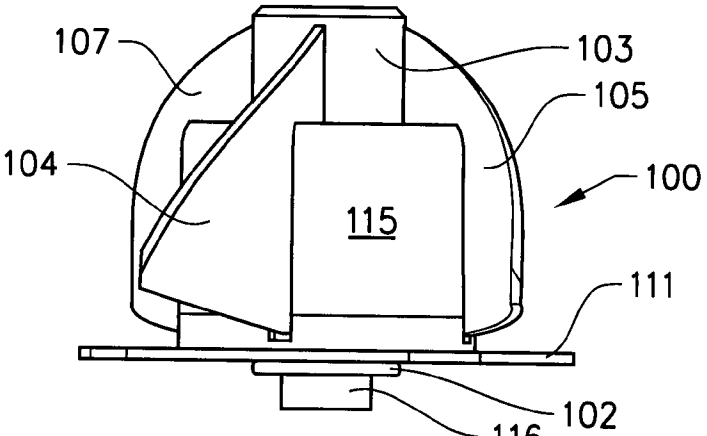
Figure 11:
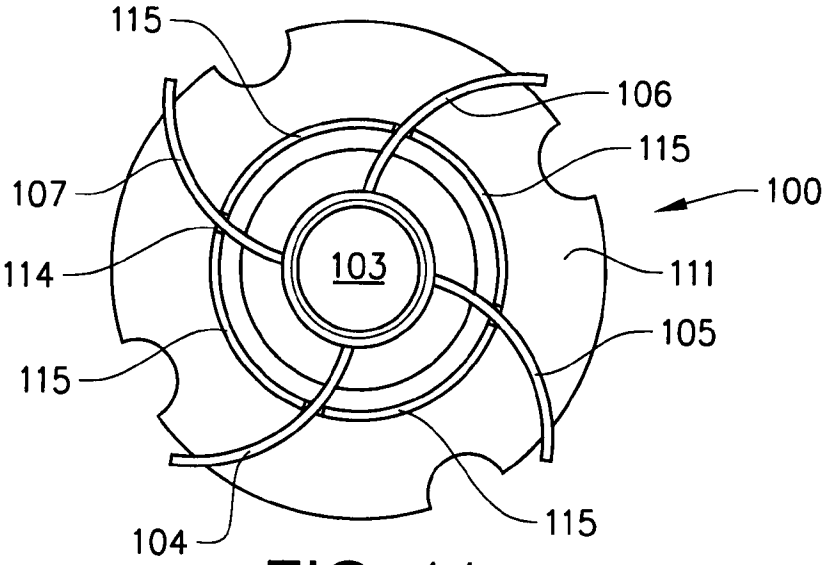
Figure 9:
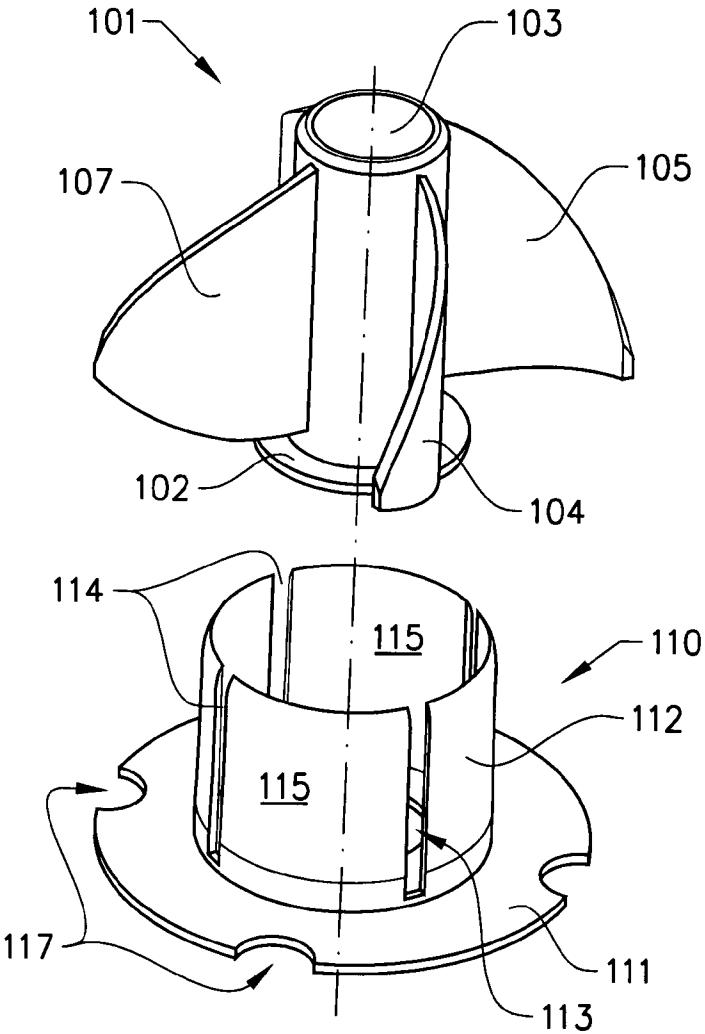

In FIGS. 9-11 an end plug 100 according to a first variant of a second embodiment is shown. The end plug 100 consists of two parts, a first part 101 being similar to the end plug 1 in FIGS. 1-3 and a second part 110. The components of the first part 101 corresponding to similar components of the end plug 1 are given the same reference numerals with the addition of 100 and for description thereof the description given of end plug 1 with reference to FIGS. 1-3 is referred to. The only significant difference between end plug 1 and the first part 101 is that the end plate 102 of the first part 101 has a smaller dimension than the end plate 2 of end plug 1.

The second part 110 of end plug 100 comprises an end plate 111 and a cylindrical sleeve 112 projecting from end plate 111 perpendicular to the plane of said end plate. The end plate 111 of the second part has a central opening 113 for accommodating the end plate 102 of the first part 101 in the assembled condition of the end plug 100. The cylindrical sleeve 112 projects concentrically to said central opening 113 and is by slots 114 divided into as many equal segments 115 as there are wing-shaped elements 104-107 protruding from the central body 103 on the first part 101, in the shown variant four segments 115. The slots 114 have a width at least as large as the thickness of the wing-shaped elements to be able to accommodate the wing-shaped elements 104-107 therein.

In FIGS. 10 and 11, the end plug 100 is shown in a side view and a plan view, respectively in its assembled condition. The assembling of the first and second parts 101 and 110 of end plug 100 consists in pushing the second part 110 onto the first part 101 so that the walls of the wing-shaped elements are placed within the slots 114 and so that the end plate 102 of the first part fits into the central opening 113 of the end plate 111 of the second part 110.

The insertion procedure of end plug 100 is the same as the insertion procedure for the end plug 1 described with reference to FIGS. 1-3 when it is inserted by pushing and clockwise rotation of the second part 110 of the end plug, the only difference being that the wing-shaped elements 104-107 will bend around the edges of segments 115 instead of around the interfaces between the bases of elements 104-107 and the central body 103. When the end plug 100 is fully inserted the tip portions of the wing-shaped elements 104-107 will be resiliently abutting the interior wall of a coreless paper roll. If the clockwise rotation of the second part 110 then is continued, the edges of the segments 115 will try to force the wing-shaped elements outwardly. The tip portions thereon will still be in abutment with the interior wall of the paper roll and are thereby held in the same positions due to the frictional forces. The continued rotation of the second part 110 will thus result in a further bending of the wing-shaped elements so that their curvature increase, in turn increasing the resilient forces acting on the interior wall of the coreless paper roll. The end plug 100 can also be inserted by pushing and rotation of the first part 101. In such a case, the procedure will be the same as for the end plug 1 as described with reference to FIGS. 1-3. The inward bending of the wing-shaped elements 104-107 will slightly move the segments 115 in an anticlockwise direction. After the end plug 100 has been fully inserted into a central hole in a coreless paper roll with the tip portions of the wing-shaped elements in abutment to the interior wall of the paper roll, the second part 110 of the end plug 100 is rotated clockwise in relation the first part 101. The edges of the segments 115 will then try to move the wing-shaped elements outwardly which will result in a further bending of the portions of the wing-shaped elements located outwardly of the edges of the segments 115 and consequently higher resilient forces acting on the interior wall of the paper roll.

Notches 117 are made in the end plate 111 in order to facilitate rotational movement of part 110 and a peg 116 or the like on first part 101 co-operating with a dispenser can be used for facilitating rotational movements of the first part 101.

In FIG. 12-16 an end plug 100' according to a variant of the second embodiment is shown. The only difference between the end plug 100' and the end plug 100 described with reference to FIGS. 9-11 is that the slots 114' are wider than the slots 114 and consequently the segments 115' are smaller in a circumferential direction than segments 115. The components of end plug 100' are given the same reference numerals as corresponding components of end plug 100 described with reference to FIGS. 9-11.

Figure 15:
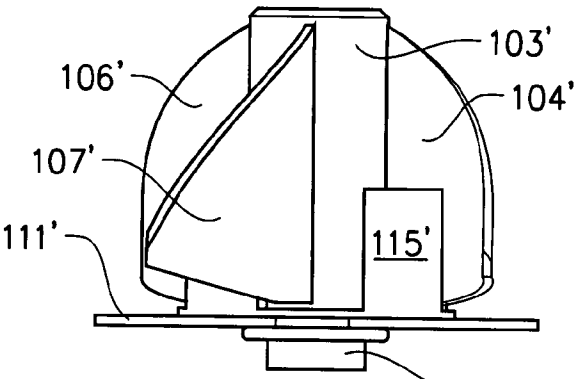
Figure 16:
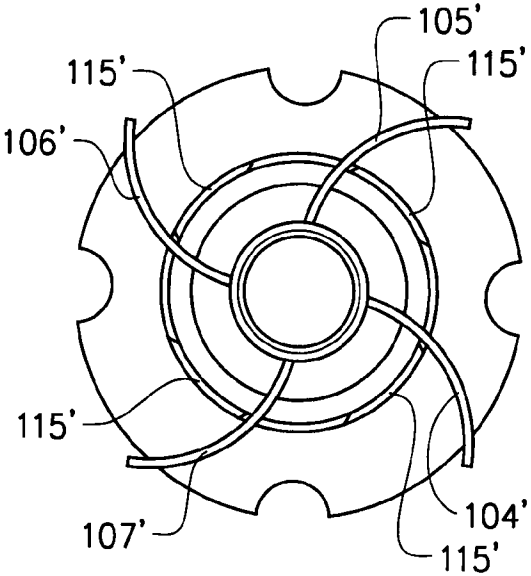
Figure 13:
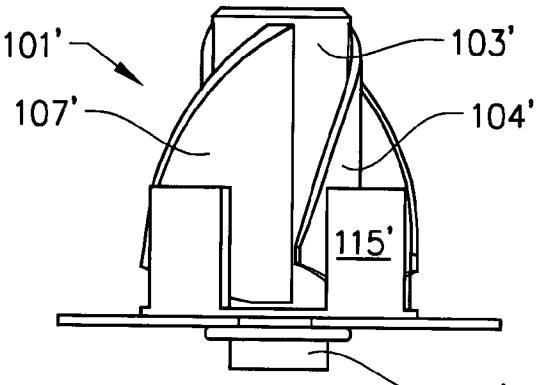
Figure 14:
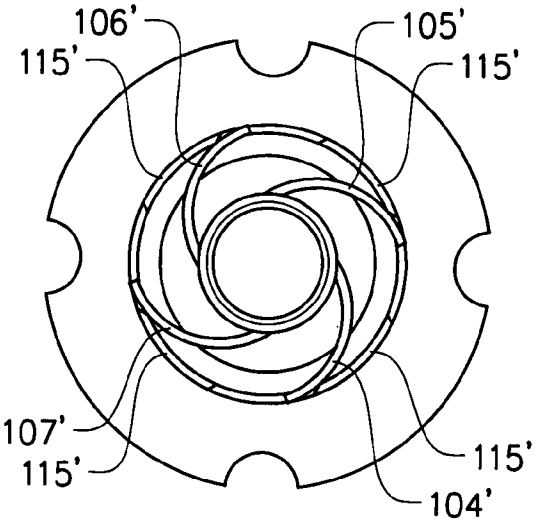
Figure 12:
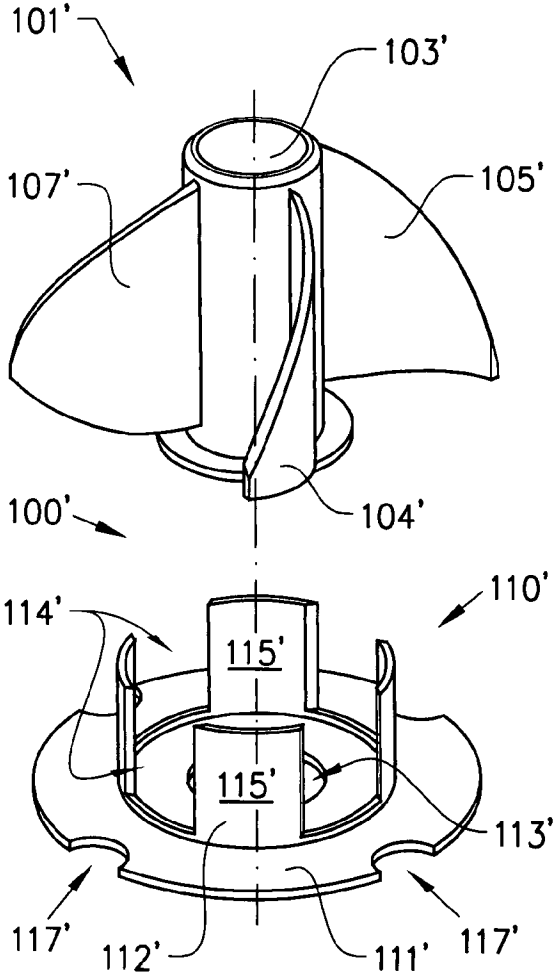

The end plug 100' is assembled the same way as the end plug 100 according to FIGS. 9-11. However, before insertion of the end plug 100' into the central hole of a coreless paper roll, the second part 110' is rotated anticlockwise in relation to the first part 101'. Thereby, the segments 115' will come to abutment against the wing-shaped elements 104'-107' and further anticlockwise rotation of the second part 110' will induce a bending of the wing-shaped elements 104'-107' in towards the central body 103' of the first part 101'. When the segments 115' cover outer portions of the wing-shaped elements 104'-107', the anticlockwise rotation of the second part 110' is stopped. This situation is shown in FIGS. 14 and 15 in a side and plan view, respectively. As can be understood by these figures the segments 115' will hold the wing-shaped elements in a position where these elements are accommodated inside the sleeve 112' constituted by the segments 115'. The end plug 100' is then pushed into the central hole of the end of a coreless paper roll until the end plate 111' of the second part 110' comes to abutment against the side wall of the paper roll. Thereafter, the second part 110' is rotated clockwise in relation to the first part 101' whereby the segments loose their grips on the outer portions of the wing-shaped elements 104'-107' and these will move outwardly due to their resiliency until they come into abutment with the interior wall of the coreless paper roll. Also in this variant the wing-shaped elements will resiliently press against the interior wall of the paper roll after insertion of the end plug.

The end plug 100' can of course instead be inserted into a central hole of a coreless paper roll in the way described with reference to FIGS. 9-11 and the end plug 100 can be inserted the same way as described for plug 100' with reference to FIGS. 12-16.

Instead of pegs 13,13'116,116' provided on the end plugs 1,1'101,101' for cooperation with a recess or the like on a dispenser, the end plugs could be provided with a centre hole or the like for cooperation with peg or the like projecting from a dispenser.

Figure 18:
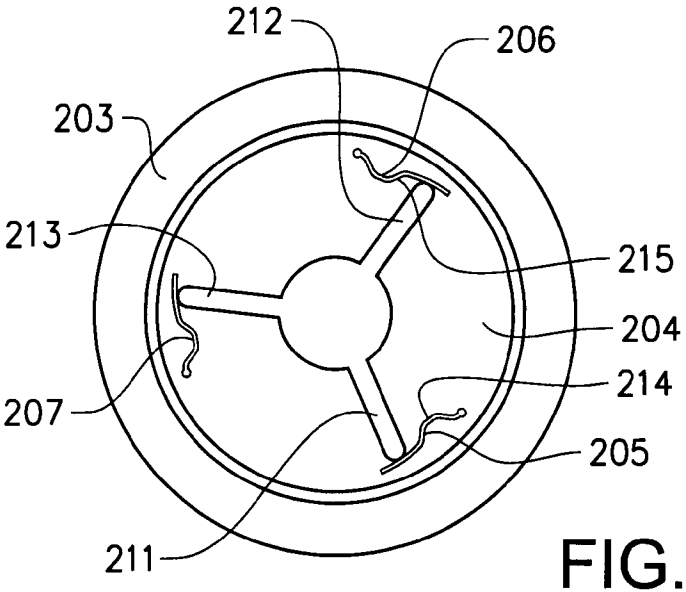
Figure 19:
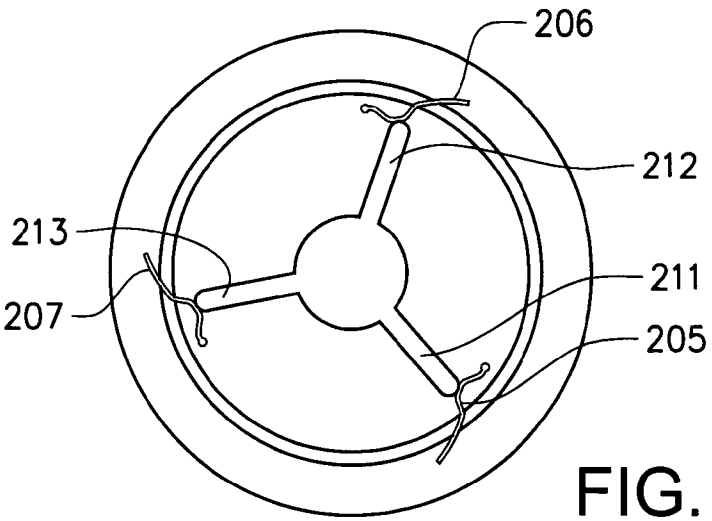
Figure 17:
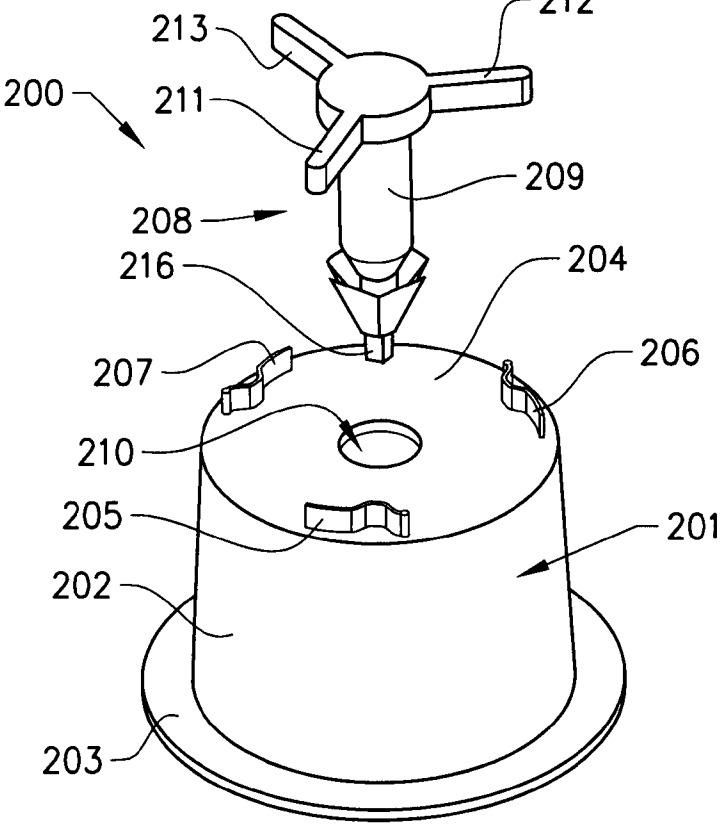

In FIGS. 17-19, an end plug 200 according to a third embodiment is shown. The end plug 200 includes a central body 201 with a slightly conical axial wall 202. By the term "axial wall" is in this description meant that said wall is extending in the direction in which the end plug is inserted into the central hole in one end side of a coreless paper roll. In the end of the conical wall having the largest diameter a flange 203 is extending outwardly in a radial direction and in the opposite end, the insertion end, a bottom plate 204 extends in a radial plane.

Three resilient elements in form of tongues 205-207 protrude axially from the bottom plate 204. The tongues 205-207 are attached to the bottom plate 204 only in one of their two ends and are resiliently swingable around the attachment points to the bottom plate 204. The three tongues 205-207 are located near the circumference of the bottom plate and are in the rest position shown in FIGS. 17 and 18 extending essentially in a circumferential direction. The tongues 205-207 are also equispaced around the circumference of the bottom plate 204 in the shown preferred alternative of this embodiment.

The central body 201 comprises means for swinging the resilient elements from the rest position inside of the circumference of the central body, shown in FIGS. 17 and 18, to a work position outside of the circumference of the central body, shown in FIG. 19. Said means is an actuator 208 having an operating rod 209 which is rotatably held in a circular central hole 210 in the bottom plate 204, and three actuating pins 210-212 for acting on the tongues 205-207 when the actuator 208 is rotated. Said pins 211-213 extend radially from the end portion of operating rod 209 extending axially out of the hole 210 in the bottom plate outside the central body 201. In the rest position of the tongues 205-207, the outer ends of the pins 211-213 are in abutment against the free ends of the tongues 205-207, as can be seen in FIG. 18.

When used, the end plug 200 is fully inserted into a central hole in the one side of a coreless paper roll with the tongues 205-207 in their rest position shown in FIGS. 17 and 18. Thereafter, the operating rod 209 is rotated in the clockwise direction in relation to the central body so that the pins 211-213 are moved towards the attached ends of the tongues 205-207. The tongues 205-207 each has a portion 214 intermediate their opposite ends which has an extension radially inwardly of the free end of the tongue, said intermediate portion 214 being connected to the free end of the tongue via a sloping portion 215, as can be seen in FIGS. 17-19. When the pins 211-213 reach said sloping surfaces 215, further rotation of the pins will cause the tongues 205-207 to swing outwardly outside of the circumference of the central body 201 and thereby press resiliently against the interior wall of the paper roll, as is illustrated in FIG. 19.

The actuator 208 has also a peg 216 in the end opposite to the end containing pins 211-213, which peg protrude axially outside of flange 203. This peg can be used to rotate actuator 208.

In FIGS. 20-24, an end plug 300 in accordance with a fourth embodiment is shown. The end plug 300 includes a central body 301 with a slightly conical axial wall 302 terminated by a cup-shaped bottom portion 303 in the insertion end thereof. In the end opposite to the insertion end, the central body 301 has an outwardly extending flange 304.

Tongues 305-308 extending in the circumferential direction are cut out in the axial wall 302 and are equispaced to each other. Furthermore, axial slots 309 extending through the axial wall 302 along the free end of each tongue up to the end thereof containing the flange 304 are made in the central body 301. In the rest position shown in FIGS. 21 and 22, the tongues 305-308 are flush with the axial wall 302.

Figure 21:
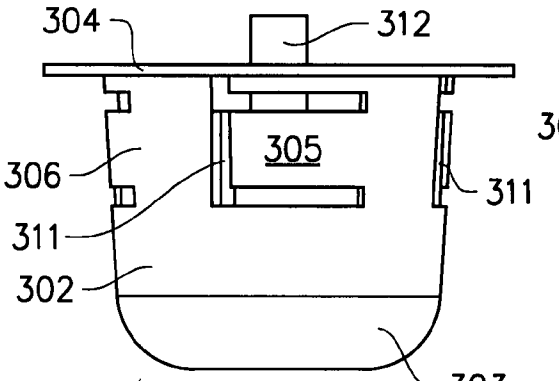
Figure 22:
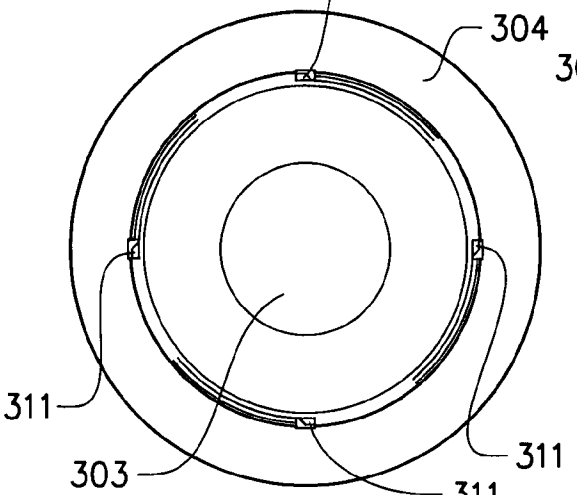
Figure 20:
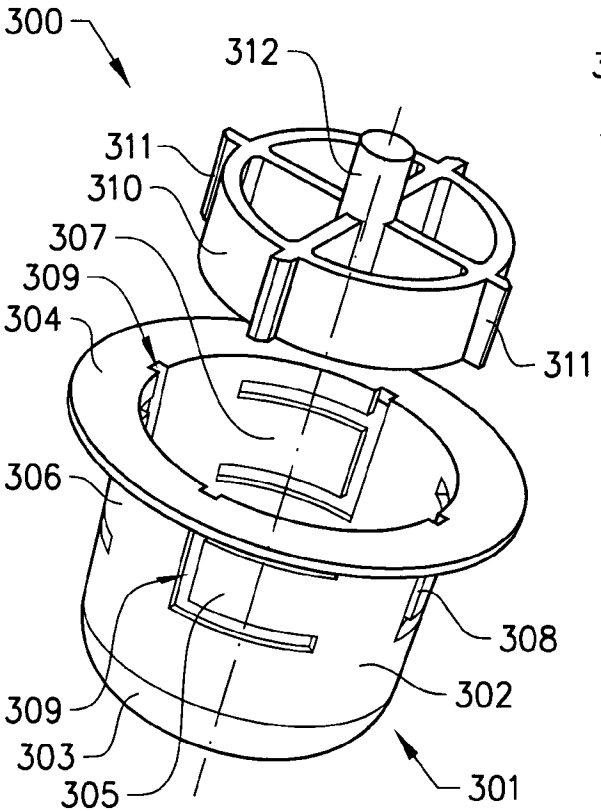

Means for moving the tongues 305-308 outwardly from the rest position are included in the central body 301. Said means has the form of an annular ring 310 having four equispaced ribs 311 protruding outwardly from the outer periphery of ring 310. In the rest position, these ribs 311 are located in the axial slots 309 in the central body 301, as illustrated by FIGS. 21 and 22.

Figure 23:
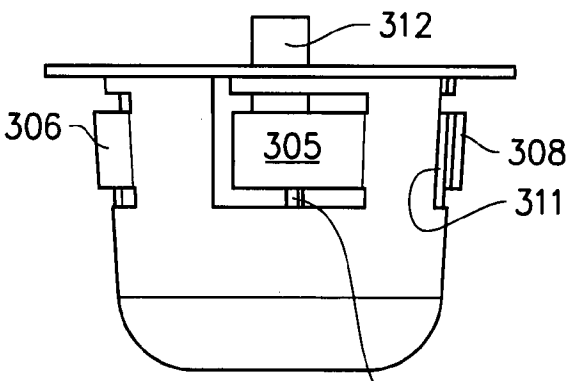
Figure 24:
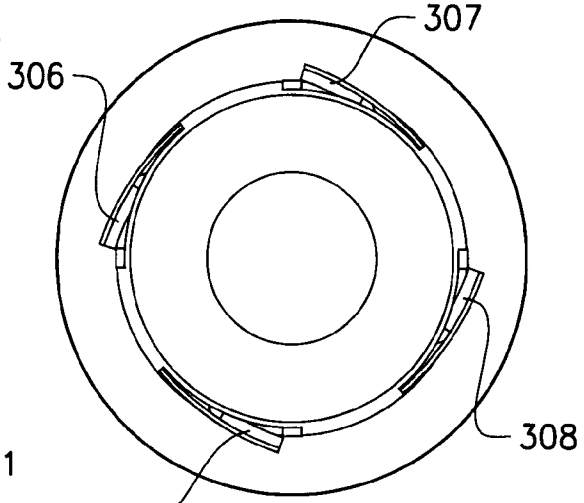

When used the end plug 300 is fully inserted into the central hole in one of the two sides of a coreless paper roll. Thereafter, the ring 310 is rotated in the anticlockwise direction in relation to the central body 301. Thereby the ribs 311 will be moved from a position adjacent to the free ends of the tongues 305-308 to a position near the base end of the tongues, i.e. the end thereof connected to the central body, as is illustrated in FIGS. 23 and 24. Thereby, the ribs 311 will press the tongues 305-308 outwardly and the tongues will press resiliently against the interior wall of the paper roll.

A peg 312 is protruding from the outer end of ring 310 for co-operation with a suitable dispenser.

Notches (not shown) can be provided in the flange 203 according to the third embodiment or the flange 304 according to the fourth embodiment for facilitating holding still of central bodies 201 and 301, respectively during rotation of actuator 208 and ring 310.

Figures 25, 26, 27:
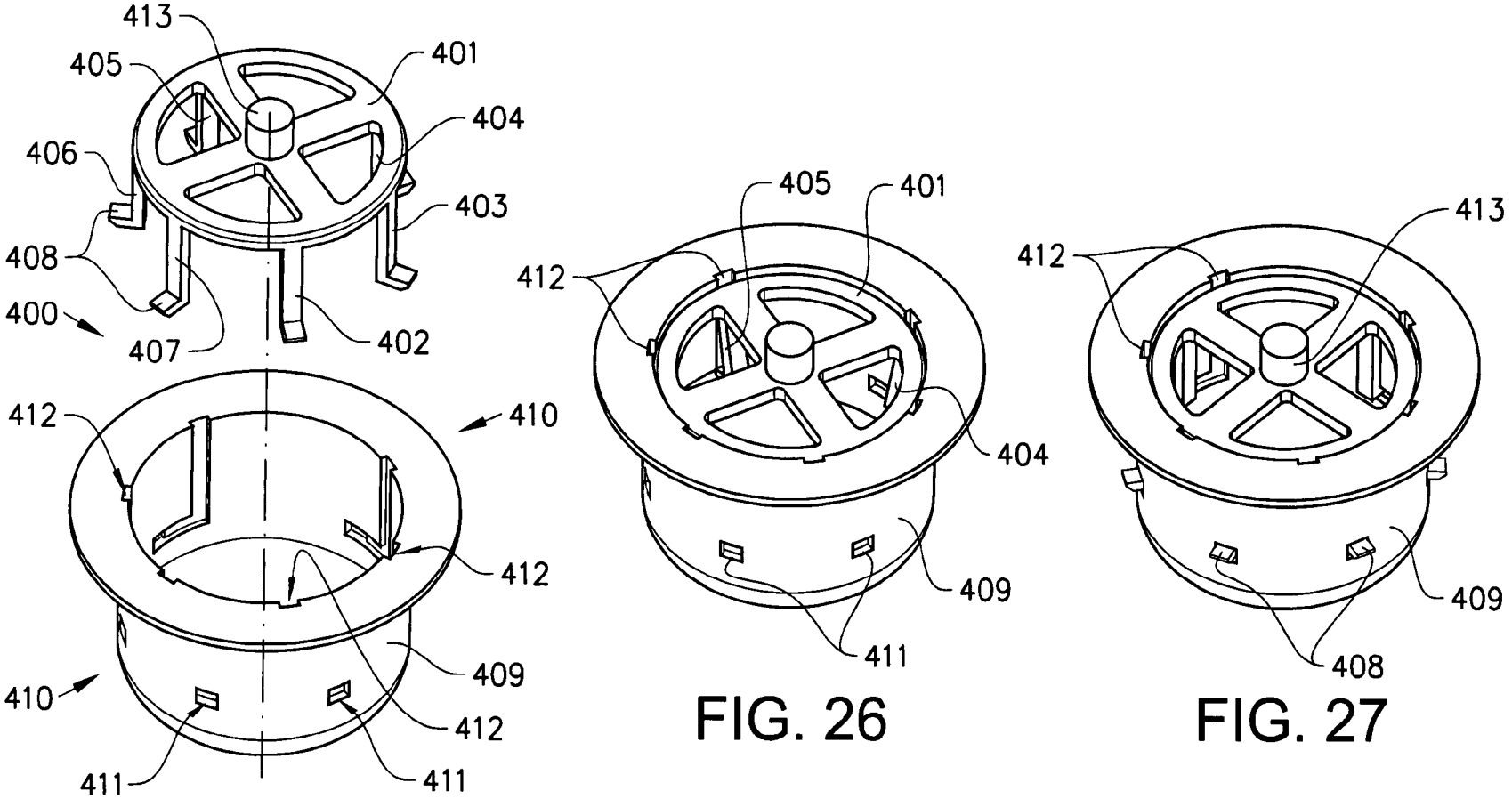

An end plug 400 according to a fifth embodiment is shown in FIGS. 25-27. The end plug 400 includes a central body 401 in form of an annular ring. From this central body 401 six resilient elements 402-407 in form of rods are extending in an axial direction. From the free end of each resilient element 402-407 a projection 408 is extending outwardly in a radial direction. In a rest position of the resilient elements said projections are held inside a cylindrical wall 409 of a second body 410 coaxially enclosing the central body 401 and the resilient elements protruding therefrom. Said cylindrical wall 409 has a row of six openings 411 therein. The second body 410 is rotatable relative to the central body 401 for bringing the resilient elements 402-407 to a work position in which the projections 408 of the resilient elements 402-407 snap into said openings 411 and extend outside the cylindrical wall 409. The cylindrical wall 409 also includes grooves 412 for guiding the resilient elements to the rest position during assembling of the end plug 400 by threading the second body onto the central body 401.

The end plug 400 with the resilient elements 402-407 in rest position is shown in FIG. 26 whereas FIG. 27 show the end plug 400 with the resilient elements in a work position.

When used, the end plug 400 is inserted into the central hole in one of the two sides of a coreless paper roll with the resilient elements 402-407 in a rest position. After the end plug has been fully inserted, the second body 410 is rotated anticlockwise in relation to the central body 101 whereby the projections 408 will snap into the openings 411 and project outside of the axial wall 409 resiliently pressing against the interior wall of the paper roll.

Also in this embodiment a peg 413 for co-operating with a dispenser is protruding axially from the central body and notches can provided in a flange of the second body 410.

In all embodiments the resilient elements are of course of a resilient material which mean that they strive to retain a relaxed condition when moved out of or deformed from a relaxed condition. Furthermore, is the end plug as a whole made of a resilient material, such as polyethylene. Other plastic material, such as polypropylene could also be used. In all the disclosed embodiments, the resilient elements are of the same material as the rest of the end plug, which is preferred, but it is of course possible to manufacture the separate components of the plug from different materials. The tongues in the third (FIGS. 17-19), fourth (FIGS. 20-24) or fifth (FIGS. 25-27) embodiment can for example be made of a springy metal whereas the rest of the end plug can be made of plastic material. Other modifications of the described embodiments can also be made without leaving the scope of invention. For example can the number of resilient elements be varied in all embodiments, however, fewer than three resilient elements should not be present and the configurations and size of the elements can be varied. The projections and openings according to the fourth (FIGS. 22-28) or the fifth embodiment (FIGS. 29-35) can have a larger extension in the circumferential direction than shown in this embodiment. In the fourth and fifth embodiments, the insertion end part of central body and second body, respectively can have a more conical appearance in order to facilitate the initial placing of the end plug into the central hole of a coreless paper roll. The scope of the present invention shall therefore only be limited by the content of the enclosed patent claims.

The invention claimed is:

1. An end plug for coreless paper rolls comprising:

a cylindrical central body having an axial extension and an outer surface; and at least three resilient elements that begin curving radially outwardly directly from the outer surface of the central body at a proximal end of the resilient elements and resiliently press against the interior of a paper roll at a distal end of the resilient elements when the end plug is inserted into an end of the paper roll, the proximal end and the distal end having the same thickness as viewed in the axial extension, said resilient elements having a radial extension, which is influenced by rotation of said plug or a part thereof, said resilient elements extending axially along the central body and each having two opposed side surfaces facing circumferentially relative to the central body and which curve in the same direction as each other from the outer surface of the central body before insertion of the end plug into the end of the paper roll, said resilient elements having a front portion and a rear portion opposite the front portion in a direction along the axial extension, said resilient elements each having a shape in which the front portion extends along the axial extension at an inclined angle directly from the central body and to a radially-outermost wall that is parallel to the axial extension, and the length of the front portion is greater than the length of the radially-outermost wall, and each of said resilient elements is divided by a hinge line into a tip portion and a base portion so that a hinge exists between the tip portion and the base portion, the hinge comprising a region of reduced thickness so as to increase flexibility of the resilient elements at the hinge.

2. A coreless paper roll having an end plug according to claim 1 inserted into at least one end thereof.

3. The end plug according to claim 1, wherein each of the resilient elements has a substantially triangular shape as viewed in a direction perpendicular to the axial extension of the cylindrical central body.

4. The end plug according to claim 1, wherein the angle between an axial plane, which passes through a base of at least one resilient element, that is the interface between the central body and the at least one resilient element, and the at least one resilient element is variable by rotating a second body in relation to the central body, said second body having axially extending parts abutting the resilient elements at a distance from the base thereof during rotation of the second body in relation to the central body.

5. The end plug according to claim 1, wherein each resilient element has a tip and a base, and an imaginary line between the tip of a resilient element and its base, that is the interface between the central body and the resilient element, forms an acute angle ($\alpha$) to a tangential plane passing through said base.

6. The end plug according to claim 5, wherein each of said resilient elements is arcuate before insertion of the end plug into the end of the paper roll.

7. The end plug according to claim 5, wherein the acute angle ($\alpha$) is present before insertion of the end plug into the end of the paper roll.

8. The end plug according to claim 5, wherein the hinge line is a weakening line that weakens each resilient element.

9. The end plug according to claim 1, further comprising an end plate at one end of the cylindrical central body and proximate the rear portion of the resilient elements, the end plate having an outer diameter that is larger than the radial extension of the resilient elements.

10. An end plug for coreless paper rolls comprising:

a central body having an axial extension and an outer surface;

at least three resilient elements extending outwardly directly from the outer surface of the central body and resiliently pressing against the interior of a paper roll when the end plug is inserted into an end of the paper roll, said resilient elements having a radial extension, which is influenced by rotation of said plug or a part thereof, and a perimeter of each of said resilient elements forms a substantially triangular shape and each extending axially along the outer surface of the central body at a different circumferential position around the central body, and the central body forms a complete circle around a circumference of the central body including at portions of the outer surface from which the resilient elements extend; and a second body detachably attached to the central body, said second body having an end plate and axially extending walls projecting from the end plate, the axially extending walls being separated from each other by axially extending slits;

wherein each of the resilient elements protrudes radially through one of the axially extending slits.

11. The end plug according to claim 10, wherein the end plate includes gripping notches at an outer circumferential surface of the end plate, to facilitate gripping of the end plate.

12. The end plug according to claim 10, wherein the resilient elements have a larger radial extension than the end plate before insertion of the end plug into the end of the paper roll.

13. The end plug according to claim 10, wherein a front portion of the resilient elements extends along the axial extension at an inclined angle directly from the central body and to a radially-outermost wall of the resilient elements that is parallel to the axial extension.

* * * * *